US009757768B2

(12) United States Patent
Chiu et al.

(10) Patent No.: US 9,757,768 B2
(45) Date of Patent: Sep. 12, 2017

(54) METHOD FOR MANUFACTURING SIZED CARBON FIBERS FOR COMPOSITE APPLICATIONS

(71) Applicant: Cytec Industries Inc., Woodland Park, NJ (US)

(72) Inventors: Shao C. Chiu, Alpharetta, GA (US); Longgui Tang, Greenville, SC (US); Billy D. Harmon, Simpsonville, SC (US)

(73) Assignee: CYTEC INDUSTRIES INC., Woodland Park, NJ (US)

( * ) Notice: Subject to any disclaimer, the term of this patent is extended or adjusted under 35 U.S.C. 154(b) by 169 days.

(21) Appl. No.: 14/551,128

(22) Filed: Nov. 24, 2014

(65) Prior Publication Data

US 2016/0221034 A1 Aug. 4, 2016

Related U.S. Application Data

(60) Provisional application No. 61/920,040, filed on Dec. 23, 2013.

(51) Int. Cl.
*B05D 1/18* (2006.01)
*B05D 3/10* (2006.01)
(Continued)

(52) U.S. Cl.
CPC ..... *B05D 3/007* (2013.01); *B05D 1/18* (2013.01); *B05D 3/0254* (2013.01); *B05D 3/107* (2013.01);
(Continued)

(58) Field of Classification Search
CPC ..... D06M 15/53; D06M 15/55; D06M 15/59; D06M 15/63; D06M 15/327; D06M 23/10; D06M 2101/40; Y10T 977/742; Y10T 977/745; Y10T 977/746; Y10T 977/847; B05D 1/18; B05D 3/007; B05D 3/107; B05D 7/24; B05D 2203/00;
(Continued)

(56) References Cited

U.S. PATENT DOCUMENTS 3,806,489 A 4/1974 Jean-Philippe Rieux
3,914,504 A 10/1975 Weldy
(Continued)

FOREIGN PATENT DOCUMENTS

WO WO 2010/136720 A1 * 12/2010

OTHER PUBLICATIONS

Hassan et al. "Water Solubility Characteristics of Poly(Vinyl Alcohol) and Gels Prepared by Freezing/Thawing Processes." in Water Soluble Polymers, edited by Amjad, 31-40. New York: Plenum Press, 1998.*

*Primary Examiner* — William Phillip Fletcher, III
(74) *Attorney, Agent, or Firm* — Thi Dang

(57) ABSTRACT

Various embodiments directed towards methods of applying sizing to fibers are disclosed herein. In some embodiments, solvent can be used to dissolve a sizing material into a solution, which can then be used to coat the fibers. In some embodiments, a water bath is used to coagulate a sizing on the fiber surface and to remove the remove solvent after coating the fibers, so that water vapor can be created during a subsequent drying step as opposed to solvent vapors. In some embodiments, strong acids or strong bases can be used as the solvent.

18 Claims, 12 Drawing Sheets

(51) Int. Cl.

| | |
|---|---|
| ***B05D 3/00*** | (2006.01) |
| ***B05D 7/24*** | (2006.01) |
| ***D06M 15/327*** | (2006.01) |
| ***D06M 15/53*** | (2006.01) |
| ***D06M 15/55*** | (2006.01) |
| ***D06M 15/59*** | (2006.01) |
| ***D06M 15/63*** | (2006.01) |
| ***D06M 23/10*** | (2006.01) |
| ***B05D 3/02*** | (2006.01) |
| *D06M 101/40* | (2006.01) |

(52) U.S. Cl.

CPC ..... *B05D 7/24* (2013.01); *D06M 15/327* (2013.01); *D06M 15/53* (2013.01); *D06M 15/55* (2013.01); *D06M 15/59* (2013.01); *D06M 15/63* (2013.01); *D06M 23/10* (2013.01); *B05D 2203/00* (2013.01); *B05D 2203/30* (2013.01); *B05D 2256/00* (2013.01); *B05D 2401/20* (2013.01); *B05D 2401/21* (2013.01); *B05D 2504/00* (2013.01); *B05D 2505/50* (2013.01); *B05D 2508/00* (2013.01); *D06M 2101/40* (2013.01)

(58) Field of Classification Search

CPC ..... B05D 2203/30; B05D 2256/00; B05D 2401/20; B05D 2401/21; B05D 2504/00; B05D 2505/50; B05D 2508/00

USPC ..... 427/337, 340, 434.6; 423/447.1, 447.2

See application file for complete search history.

(56) References Cited

U.S. PATENT DOCUMENTS

| | | | | |
|---|---|---|---|---|
| 3,943,090 | A | 3/1976 | Enever | |
| 3,957,716 | A | 5/1976 | Weldy | |
| 4,264,655 | A | 4/1981 | Brook | |
| 4,364,993 | A | 12/1982 | Edelman et al. | |
| 4,443,566 | A | 4/1984 | Ying | |
| 4,446,255 | A | 5/1984 | Ying et al. | |
| 4,555,446 | A | 11/1985 | Sumida et al. | |
| 5,472,607 | A * | 12/1995 | Mailvaganam ..... | B01D 69/08 210/490 |
| 5,910,456 | A * | 6/1999 | Matsuhisa ..... | C08J 5/042 428/408 |

* cited by examiner

METHOD FOR MANUFACTURING SIZED CARBON FIBERS FOR COMPOSITE APPLICATIONS

BACKGROUND

Field of the Invention

Disclosed herein is a method of applying a sizing material to a fiber by use of a solvent. The method can be used to engineer the interface between the fiber and other components of a composite material into which the fiber is incorporated. In various embodiments, the method provides improved manufacturing processes and/or a composite material having improved properties.

Description of the Related Art

While carbon fibers can be used to make extremely strong products, carbon fibers themselves can be extremely fragile during processing and therefore can easily break under outside forces. To combat this fragility of the fibers, a coating can be applied to the fibers that acts as a protective barrier for preventing breakage. Typically, a material known as size or sizing is coated onto the carbon fibers to act as a protective layer and/or surface modifier. Furthermore, sizing can be used to modify the surface of the fibers, such as enhancing adhesion to the fiber of a polymer matrix. Sizing can be useful in improving the resulting composite performance. Different types of sizing can be used based on desired final qualities of the carbon fiber coating. Sizing can be applied to various types of fibers, including inorganic and organic fibers.

Historically, there have been two primary industry standard practices with regard to applying sizing to fibers (e.g., carbon fibers). First, sizing materials can be emulsified into a carrier liquid with use of a surfactant. However, use of a surfactant can negatively affect the final properties of the composite, as the surfactant may remain on the final fiber product. Moreover, many materials are incapable of being readily emulsified. For example, high molecular weight (MW) epoxies, thermoplastics, and rubbers all tend to be difficult to emulsify, and therefore are not generally used as carbon fiber sizing using the emulsification method. This leaves a substantial set of potential sizing materials that cannot be economically and/or technically used to enhance or modify the fiber surface.

A second method for applying sizing onto a fiber (e.g., carbon fiber) is through use of solvents. The sizing material can be dissolved in a specific solvent, such as an organic solvent, resulting in a solution of solvent and sizing material. Fibers can then be dipped in the solution so that the sizing/solvent solution adheres to the fibers. The fibers coated with the sizing/solvent solution are dried to remove the solvent, leaving only the sizing material on the fibers. However, the step of drying the coated fibers to remove the solvent typically produces solvent vapor, which can be hazardous to both the environment and workers exposed to the solvent vapor unless appropriate precautions are taken. For example, organic solvent vapors can be highly flammable and can catch fire and/or explode, even when substantial precautions are taken. Further, general health hazards associated with excessive solvent exposure include toxicity to the nervous system, reproductive damage, liver and kidney damage, respiratory impairment and/or cancer. Therefore, extreme care and safety costs must be taken into account when dealing with the organic vapor produced by the solvent sizing method. These precautions can make the solvent sizing method prohibitively expensive, and thus impractical.

SUMMARY

Disclosed herein is a method of applying sizing onto an organic or inorganic fiber. In some embodiments, the method can comprise providing one or more or a quantity of fibers, contacting the quantity of fibers with a composition, wherein the composition comprises a polymer dissolved in a water-miscible solvent, thereby forming a solvent/polymer coating on the quantity of fibers, coagulating the polymer onto the quantity of fibers, removing the water-miscible solvent by washing with water the quantity of fibers having the solvent/polymer coating, and at least partially drying the resultant quantity of polymer-coated fibers to produce a quantity of sized fibers.

The one or more or quantity of fibers can be chosen from carbon fibers, glass fibers, ceramic fibers, aramid fibers, polyolefin fibers, polyester fibers, acrylic fibers, and combinations thereof. In some embodiments, the quantity of fibers can be a fabric. In some embodiments, the water-miscible solvent is chosen from dimethyl sulfoxide (DMSO), N-methyl-2-pyrrolidone (NMP), dimethylformamide (DMF), hexamethylphosphoramide (HMPA), acetone, methylethyl ketone, butanone, methyl alcohol, ethyl alcohol, isopropyl alcohol, butyl alcohol, di-chloro methane, chloroform, sodium thiocyanate, and zinc chloride. In some embodiments, the solvent can have a pH of about 10 or greater or about 3 or less. In some embodiments, the solvent can be a strong base or a strong acid.

The polymer can be chosen from epoxies, thermoplastics, rubbers, and combinations thereof. In some embodiments, the polymer can be chosen from polyether sulfone, polyether ketone (e.g., PEEK), bis A epoxy, bis F epoxy, phenoxy, phenolic, vinyl ester, bismaleimide (BMI), polyimide, polyamide imide, diglycidyl ether of bis-phenol A epoxy, core-shell rubber, anthracene epoxy, naphthalene epoxy, novalac epoxy, tri-functional epoxy, tetra-functional epoxy, prepolymer, and combinations thereof. In some embodiments, the polymer has an epoxy equivalent weight of about 300 or greater. In some embodiments, the polymer has an epoxy equivalent weight of about 500 or less. In some embodiments, the polymer is a combination of different polymers.

The polymer can be modified by a modifier chosen from rubber particles, inorganic particles, organic particles, additives, and combinations thereof. In some embodiments, the rubber particles, inorganic particles, organic particles, and additives can be chosen from carbon nano tubes (CNTs), grapheme sheets, carbon microbeads, silica nanotubes, silica carbide nanotubes, nanoclays, and combinations thereof.

In some embodiments, substantially no solvent vapor is produced during the at least partially drying. In this context, water is not considered to be a solvent because the solubility of the polymer in water is very low. In some embodiments, a surfactant is not used. Water can be substantially removed from the quantity of fibers during the at least partial drying step. In some embodiments, a post-bath composition comprising water, water-miscible solvent, and polymer is formed during washing. The method can optionally further comprise recycling one or more components of the post-bath composition.

Also disclosed herein is a method of applying sizing onto a fiber and minimizing solvent vapor formation. This can comprise combining a polymer with a water-miscible solvent to form a sizing composition wherein the polymer is dissolved in the sizing composition, applying the sizing composition to at least one fiber thereby coating the at least one fiber with the polymer, coagulating the polymer onto the at least one fiber, removing the water-miscible solvent from the at least one fiber, and at least partially drying the at least one fiber after the water-miscible solvent has been removed, wherein substantially no solvent vapor is created during the at least partially drying.

Coagulating the polymer and/or removing the water-miscible solvent can comprise applying water to the at least one coated fiber.

These and other embodiments are described in greater detail below.

DETAILED DESCRIPTION

Figure 1:
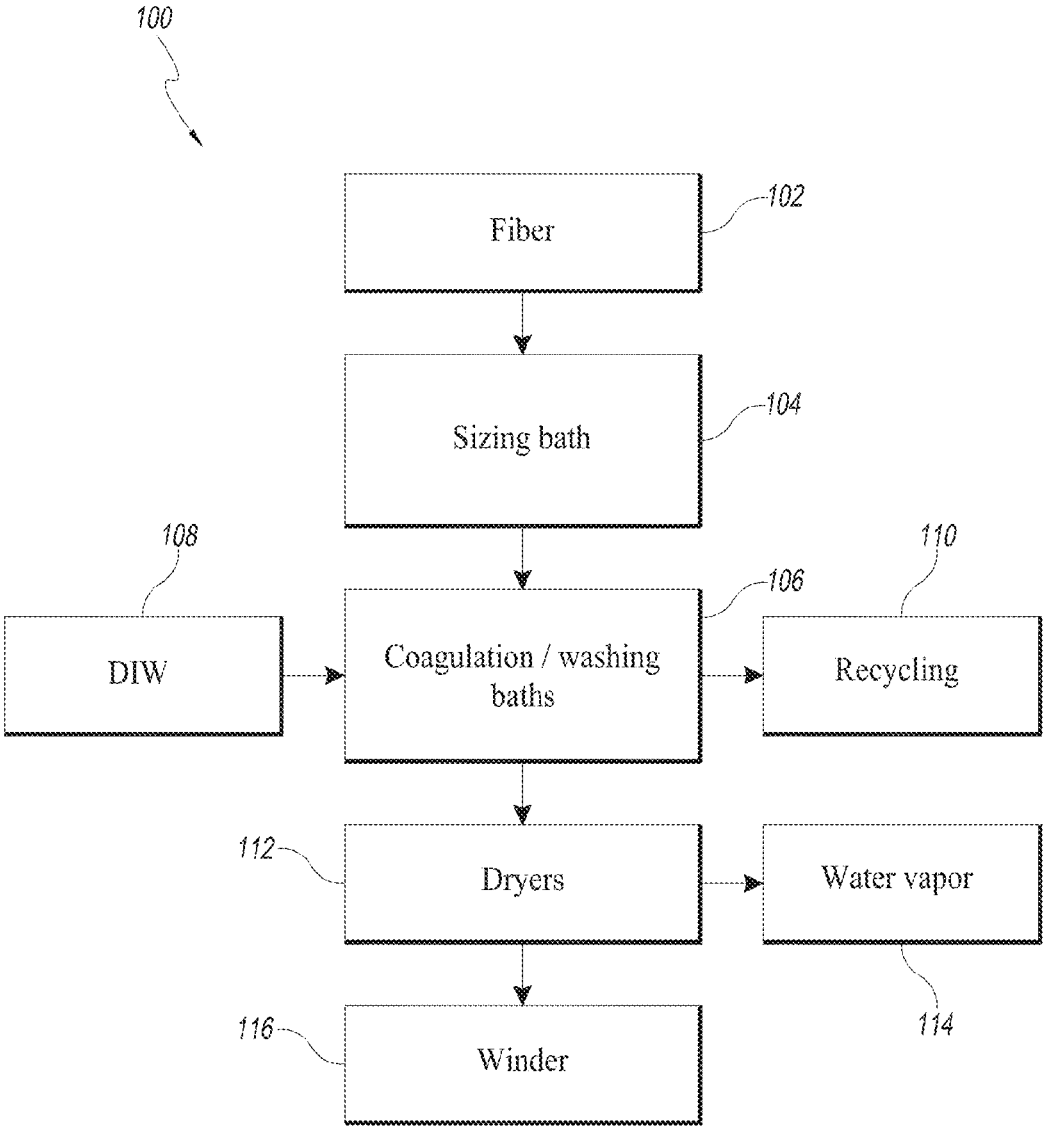
FIG. 1 schematically illustrates one embodiment of a method for applying sizing to fiber using a solvent bath and an aqueous coagulation/washing bath as disclosed herein.

Embodiments of the present disclosure provide a method of adhering material (e.g., sizing) to a quantity or group of fibers using a solvent. Specifically, the disclosed method uses a water bath to remove solvent adhering to the fibers, thereby minimizing risks during the processing of the fibers. For example, solvent vapor formation can be minimized. In addition, strongly acid or strongly basic solvents can be diluted during processing. Embodiments of the disclosed method can be used in conjunction with a typical solvent sizing adhesion method. Therefore, sizing and solvents used in the below disclosure can be understood as those commonly used, and are not limiting.

The terms "size" or "sizing" as used herein are broad terms and include their ordinary technical dictionary meaning with regards to the application to fibers. Further, the terms may also refer to any material that can be used as a coating of fibers. The type, size, molecular weight, and other properties of the sizing are not limited. For example, the sizing material can be any known sizing that can be applied to fibers via industrially acceptable solvent sizing methods. In various embodiments, the sizing is a polymer that is relatively soluble in the solvent used for sizing, but relatively insoluble in water.

The term "fiber" as used herein is a broad term and includes the ordinary technical dictionary definition, and may refer to various high performance fibers used in composite materials, including fibers such as carbon fibers (e.g., graphite fibers and graphene fibers), glass fibers such as e-glass or s-glass fibers, ceramic fibers, aramid fibers, polyolefin fibers (e.g., polyethylene and polypropylene fibers), polyester fibers, acrylic fibers, and combinations thereof. The configuration of fiber is not limited and can include, for example, bundles, tows and/or fabrics made from the above described fibers.

The term "water-miscible solvent" as used herein is a broad term and includes the ordinary technical dictionary definition. Those skilled in the art will understand that, in context of the methods described herein, water by itself is not considered to be a water-miscible solvent (although aqueous solutions such as aqueous acids and aqueous bases can be water-miscible solvents as described elsewhere herein). For example, a water-miscible solvent can be a solvent that allows for a mass transfer mechanism in which solvent from a solvent/sizing-coated fiber transfers into water and water transfers onto and/or into the sizing material, as described elsewhere herein. In some embodiments, the water-miscible solvent can have a solubility in water at 20° C. of about 1 g/L or greater, about 2 g/L or greater, about 5 g/L or greater, about 8 g/L or greater, about 10 g/L or greater, about 50 g/L or greater, or about 100 g/L or greater. In some embodiments, the water-miscible solvent can be completely miscible in water in all proportions.

In particular, a method is disclosed that allows for sizing material to be applied to fiber tow continuously in solution form while reducing or eliminating the formation of solvent vapor during production, thereby minimizing the health and/or environmental impact of the manufacturing process. As disclosed in detail below, in some embodiments, after applying size/solvent in solution form to fiber, the fibers can be washed in an aqueous bath (e.g., a water bath). The aqueous bath can allow the sizing, which typically has poor solubility in water, to coagulate and uniformly coat the fibers, while also removing any remaining solvent into the aqueous bath. In addition, the washing can help dilute any strongly acid or basic solvents used.

In some embodiments, when the fibers coated in sizing/solvent enter the aqueous bath, a mass transfer mechanism can operate in which the solvent transfers into the water and water transfers onto and/or into the sizing material. During this solvent and water exchange process, the water, being a poor solvent or non-solvent for the sizing material, can cause the sizing to precipitate/coagulate on the fibers to form a film or coating on the fiber surface. The solvent-water exchange rate, solvent concentration of the coagulation bath, solvent power, and coagulation bath temperature can all affect the formation of sizing film on the fibers. The high concentration of water in the water bath can be conducive for the solvent to move into the water phase. After the mass transfer, substantially all of the solvent is removed from the fiber and remains in the water bath.

Once the washing step is completed, the fibers can be dried to remove excess water. During the drying step, as all or nearly all the solvent has already been removed, substantially no solvent vapor may be formed. For example, only negligible levels of solvent vapor may be formed that may not be hazardous to workers. Accordingly, embodiments of the disclosed method can provide a cost effective and environmentally safer method for applying many types of sizing to fibers. In the below described embodiments, any solvents and sizing typically used by a person having ordinary skill in the art are applicable.

Embodiments of the disclosed methods can be used to apply various sizings as a coating to precursors or intermediate fiber products, such as oxidized fiber or pre-carbonized fiber. The coating can act as a process aid or property enhancer in the manufacturing of the fiber. Sizing can have numerous effects on the underlying material, and can be targeted to provide for fiber and/or composite performance improvement of a variety of properties. For example, the morphology of sizing coatings can be tailored specifically for fiber and/or composite property improvements. As mentioned above, fibers can be extremely fragile during the manufacturing process. Therefore, sizing can be applied generally as a strengthening material, and can, for example, act as a protective barrier to prevent damage to the fibers during processing. Therefore, after application of the sizing to the fibers, the fibers can be more easily handled during the manufacturing process with less potential for damage. In addition, sizing can be used to generally modify the surface of the fibers for desired characteristics and composite performance.

Sizing can affect the interface properties between the fibers and the other components of the composite material into which they are embedded, such as a matrix resin. For example, substantial load transfer can occur at the interface between fibers embedded in a resin matrix. The sizing can be used to aid adhesion of the fibers within the matrix, which helps prevent external forces from breaking the fibers away from the matrix. Further, sizing can, for example, help provide a rigid support around fibers within a resin matrix, thereby strengthening and/or toughening the composite product, as well as improving the processing ability and performance of the fibers within the matrix.

As mentioned above, sizing applications using a solvent has been the norm in the field of fibers. Solvent sizing can be preferable over emulsion sizing because of the large variety of sizing materials that can be used with the solvent. An emulsion process is limited to the use of emulsifiable sizing materials. However, in embodiments of the disclosed method, different types of sizing can be used in the disclosed process. For example, epoxies, thermoplastics, rubber, and combinations thereof can be used as the sizing material, and the type of sizing material is not limiting. Almost all kinds of polymers, thermosets, thermoplastics, or their blends can be applied to fibers as sizing in embodiments of the below described process, including those with high molecular weight (MW) or high epoxy equivalent weight (EEW).

As used herein in the context of polymers, the term "molecular weight" refers to weight average molecular weight as measured by size exclusion chromatography using light scattering detection. In some embodiments, the sizing can have a molecular weight of about 10,000 or greater, about 50,000 or greater, or about 100,000 or greater. In some embodiments, the sizing can have a molecular weight of about 500,000 or lower. In some embodiments, sizing used in the disclosed process can have a greater MW than that which would be conventionally used in an emulsion process. In some embodiments, the sizing can have an epoxy equivalent weight (EEW) of about 150 or greater, about 300 or greater, or about 500 or greater. In some embodiments, the sizing can have an epoxy equivalent weight of about 500 or lower. In some embodiments, sizing used in the disclosed process can have a greater EEW than that which would be conventionally used in an emulsion process. Specifically, polyether sulfone, polyether ketone (e.g., polyether ether ketone, PEEK), bis A epoxies, bis F epoxies, phenoxy, phenolics, vinyl esters, BMI's, polyimides, polyamide imide, diglycidyl ether of bis-phenol A epoxies, core-shell rubber, anthracene epoxies, naphthalene epoxies, novalac epoxies, tri-functional epoxies, and tetra-functional epoxies and their mixtures at various ratios can be used as sizing.

In addition, pre-polymers type sizing can be applied to fiber. In general, virtually any sizing polymer that can be dissolved in a solvent can be used, and, as described below, highly corrosive solvents can be used with embodiments of the disclosed process. Many of the above listed polymers, including epoxy materials with high epoxy equivalent weight, cannot be readily emulsified with conventional emulsion processes. In some embodiments, the sizing used can be water insoluble. Further, modifications of sizing material by adding rubber particles or inorganic particles, organic particles, or additives such as, for example, carbon nanotubes (CNTs), graphene sheets, carbon microbeads, silica nanotubes, silica carbide nanotubes, and nanoclays, can be made more easily with uniform particle dispersion.

In some embodiments, highly corrosive and/or toxic solvents can be used. For example, organic solvents, which upon drying can create undesired solvent vapors, can be used. Further, strong acids (e.g., pH 1, 2, 3, or 4) and strong bases (e.g., pH 12, 11, or 10) can be used, as some sizing (e.g., PEEK) may not be sufficiently soluble in organic solvents, but may dissolve in strong acids. Preferably, the solvents used in embodiments of the disclosed method are miscible or soluble in water.

In some embodiments, the solvent can be a polar, aprotic solvent. These types of solvents can have both high dielectric constants and high dipole moments. For example, dimethyl sulfoxide (DMSO), N-methyl-2-pyrrolidone (NMP), dimethylformamide (DMF), hexamethylphosphoramide (HMPA), and mixtures of the foregoing can be used, although the type of solvent is not limiting, and any common solvent in the field can be used with embodiments of the disclosed process. In some embodiments, other organic solvents such as acetone, methylethyl ketone, butanone, methyl alcohol, ethyl alcohol, isopropyl alcohol, butyl alcohol, di-chloro methane, and chloroform, can be used. In some embodiments, an inorganic solvent, such as those containing zinc chloride or sodium thiocyanate can be used. In some embodiments, the inorganic solvent can be an aqueous solution of a salt or salts.

Sizing Methodology

FIG. 1 illustrates a method 100 for sizing applications of a fiber, according to embodiments of the disclosure. Embodiments of the described method can be environmentally friendly as solvent vapors are substantially avoided during the process. Further, harsh solvents, such as highly acidic or highly basic solvents, can be used, while limiting the potential danger to workers exposed to the solvent by diluting the solvents during processing.

First, fibers can be produced 102. In some embodiments, the fibers are manufactured, and in some embodiments the fibers are purchased. The method of producing fibers is not limiting, and a person having ordinary skill in the art would know different methods to produce such fibers. The fibers can then be immersed in a sizing bath 104. The sizing bath 104 can contain a combination of solvent and the sizing material.

Once the fibers are coated with the solution of solvent and polymer, the solvent/sizing material covered fibers can be removed from the sizing bath 104 and placed into an aqueous coagulation/washing bath (e.g., a water bath) 106.

The bath 106 can contain still water or moving water. In some embodiments, deionized water 108 can be used, for example, to reduce metal contamination, though other types of water such as distilled and tap water can be used as well, and the type of water is not limiting. Further, while water is often convenient and economical, water does not necessarily have to be used, and a different liquid (in which the solvent is relatively soluble and the sizing is relatively insoluble) can be used to remove the solvent from the solvent/sizing coating and coagulate the sizing onto the fibers. The fibers can be actively washed in the water bath 106 or can be soaked to remove any remaining solvent. In some embodiments, the fibers can be placed into the water bath 106, and jets can create a moving stream of water to pass along the fibers. In other embodiments (not shown in FIG. 1), the polymer can be coagulated onto the fibers by other methods that do not necessarily involve immersion in a bath, for example, by spraying water onto the fibers.

Figure 2:
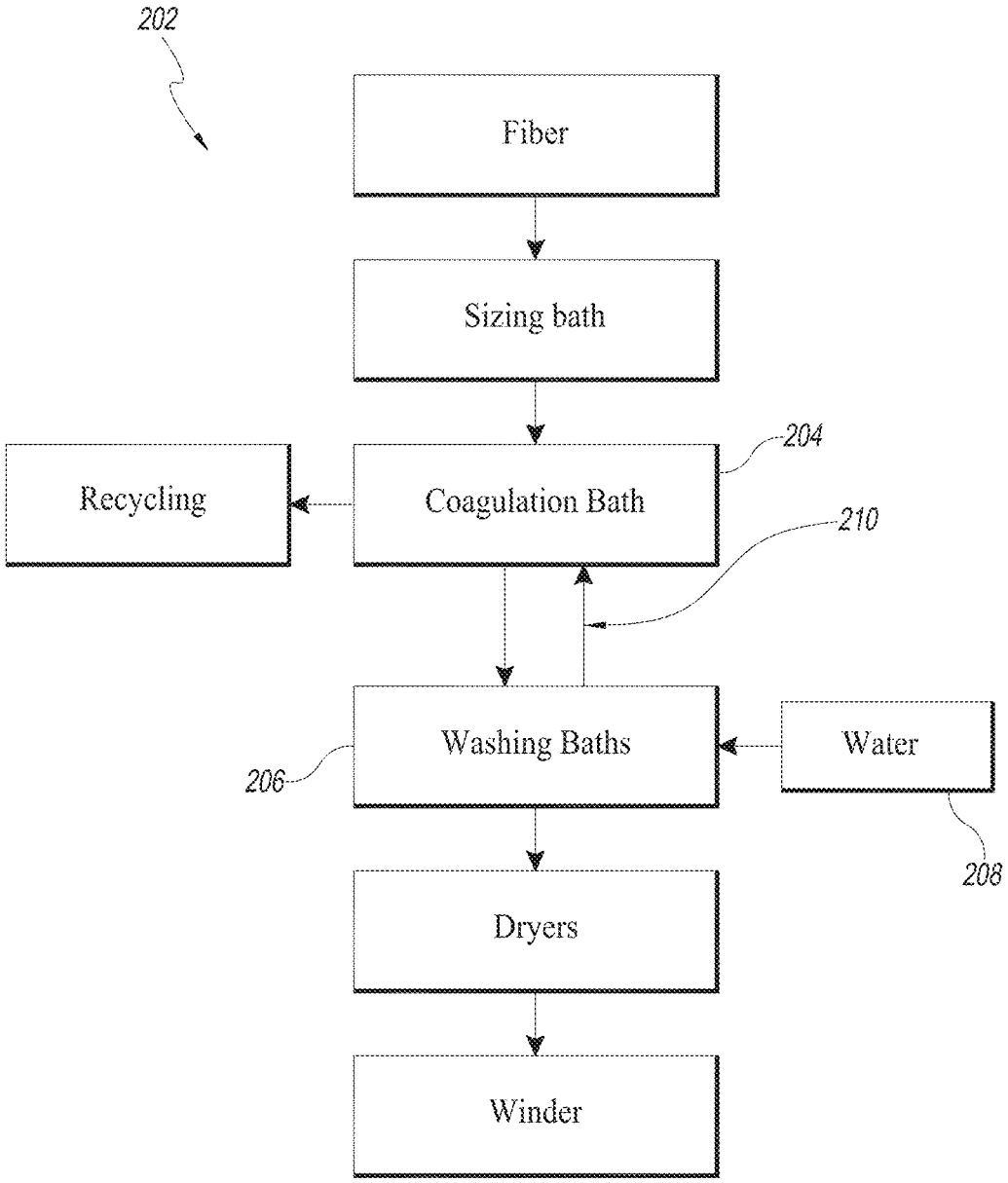
FIG. 2 schematically illustrates one embodiment of a method for applying sizing to fiber using a solvent bath and an aqueous coagulation bath as disclosed herein.

FIG. 2 illustrates an embodiment of a method for applying the sizing fiber. As shown in the method 202, the coagulation bath 204 and washing bath 206 can be separate. In some embodiments, the baths 204/206 can be connected so water can flow between. In some embodiments, the water flow is in one direction only. Therefore, the fibers can first be run through the coagulation bath 204 for the sizing to coagulate on the fibers. The fibers can then be moved to the washing bath 206, where fresh water 208, such as the water described above, can be used to wash the solvent off of the fibers. The used water can then be transported back 210 to the coagulation bath 204, which can create a cascade effect. Accordingly, in some embodiments, the water used in the coagulation bath 204 can contain both solvent and water. As shown, many of the other steps can be similar to those discussed with respect to FIG. 1, though a person skilled in the art would understand that there could be additions or removals of steps.

Referring back to FIG. 1, the washing step 106 described above can use multiple baths. In some embodiments, the multiple baths can each have 1 or more compartments, for example, at least 2, 3, 4, 5, 6, 7, 8, 9, or 10 compartments each. The baths can be arranged in a cascading fashion wherein water can overflow from one compartment to the neighboring compartment. The fibers can be washed in the first compartment and then moved in a direction generally opposite to that of the cascade to a neighboring compartment. The fibers can then be moved from the first bath to the second bath. In some embodiments, the last bath can be used to check for any residual solvent. In some embodiments, approximately 80%, 85%, 90%, 95%, 99%, 99.9% or 100% of the solvent is washed away in the washing step 106. In some embodiments, 80% or greater, 85% or greater, 90% or greater, 95% or greater, 99% or greater, or 99.9% or greater of the solvent is washed away in the washing step 106. In some embodiments, the temperature of the water in the baths can be controlled, as well as the concentration of water, and thus the ratio of water to solvent/sizing/fiber. In some embodiments, almost all of the coagulation of the sizing onto the fibers takes place in the first compartment. In some embodiments, the temperature of the water bath can be changed to create or enhance phase separations.

In the water bath of the coagulation/washing step 106, sizing material can coagulate/precipitate and adhere to the surface of the fibers. This can occur because a water-miscible solvent can be used in the coating step 104, so an exchange of solvent and water takes place to coagulate the polymer. Therefore, once the fiber is contacted with or submerged in the water, the solvent can dissolve into the water to form a solution. Further, the water-insoluble sizing can coagulate together and adhere to the surface of the fibers. In some embodiments, the fibers can be relatively hydrophobic. Thus, the water-miscible solvent can be dissolved in the water and washed away, while the sizing can remain adhered to the fibers. Further, the water baths can be used to dilute highly acidic or highly basic solvents. As the solvent/sizing coated fibers are washed in the water bath, the overall pH of the system can move closer to 7. Therefore, the coated fibers can be more easily handled.

In some embodiments, the resulting post-bath composition, comprising solvent/sizing solution mixed with water can be removed in some manner and one or more components recycled 110. In some embodiments, the post-bath composition can contain any sizing material that did not adhere to the fibers once the sized fibers are removed from the bath after step 106. In some embodiments, solvent can be recycled by distillation. In some embodiments, excess sizing, typically in the form of loose polymer particles or pieces, can be filtered out. The method of recycling the solvent and/or excess sizing is not limiting.

Once the fibers are coated with sizing material and the solvent is removed, the fibers can be dried 112. For example, ovens or general dry warm circulating air can be used to dry the fibers, though the method of drying is not limiting. In some embodiments, the fibers can be dried at a temperature in the range of about 125° C. to about 140° C. As the solvent has been substantially removed from the fibers in the water washing step 106, water vapor 114 is created during drying that contains little or no solvent vapor. Water vapor 114 can typically be removed significantly more easily than solvent vapor, and any escape or accident involving release of water vapor is generally harmless. In some embodiments, all of the water is removed during the drying step 112. In some embodiments, water can still remain on the fibers after the drying step 112. Higher temperatures, as well as other parameters, can be used in drying 112 to remove the water as compared to drying to remove solvent, as there can be significantly less danger of explosion or fire, and thus the rate of drying can be increased and and/or process throughput enhanced. After the fibers have been dried with the appropriate sizing, the sized fibers can be wound in a winder 116 for any final processing steps and shipment. However, a winder is not required, and a person having ordinary skill in the art would understand other minor processing changes that would be encompassed by this disclosure.

Previous sizing applications forgo the coagulation/washing step 106 disclosed herein. Therefore, during the later drying step 112, harmful solvent gasses/vapors tend to be created in the absence of the coagulation/washing step 106. These vapors can cause significant environmental damage, and can potentially injure workers exposed to them. For example, some solvent gasses can be flammable, which can lead to fire incidents or emergencies during fiber manufacturing steps. However, by use of coagulation/washing baths 106 described herein, the harmful effects of solvents can be minimized, if not completely removed. The water coagulation/washing step 106 can eliminate the need for any handling of organic vapor in a sizing dryer, which can be a major problem in conventional solvent sizing process. Further, the washing step 106 can be used to dilute highly acid or basic solvents.

Further, as all or virtually all of the solvent is removed prior to drying, in various embodiments any uncompleted drying will not cause fiber stickiness problems in package handling and fiber pay-off. Stickiness can lead to accidents and fiber breakage. Further, more care needs to be taken when fibers are sticky, potentially leading to production slowdowns.

In addition, multiple different sizing materials can be blended together for use in the above disclosed process. For example, a first sizing polymer can be blended with a second soluble polymer component or a second non-soluble polymeric or inorganic component.

Therefore, the process described herein can produce fibers with applied sizing at the safety levels of an emulsion method while not having its numerous drawbacks and limitations. For example, the disclosed process allows for use of a broader range of sizing material. Furthermore, the disclosed processes allow for reduction or elimination of the use of surfactants, which can have a negative impact on the final composite properties. Moreover, removal of the surfactant step can decrease overall manufacturing costs while increasing the ease of manufacturing the fibers. In addition, the disclosed process can be run in a manner that produces little or no potentially dangerous organic vapors, unlike typical solvent application methods, thereby increasing the overall safety of the fiber sizing process.

EXAMPLES

The following examples are provided to demonstrate various aspects and/or benefits of embodiments of the disclosed sizing methods versus other sizing methods. These examples are discussed for illustrative purposes and should not be construed to limit the scope of the disclosed embodiments.

Figure 3A:
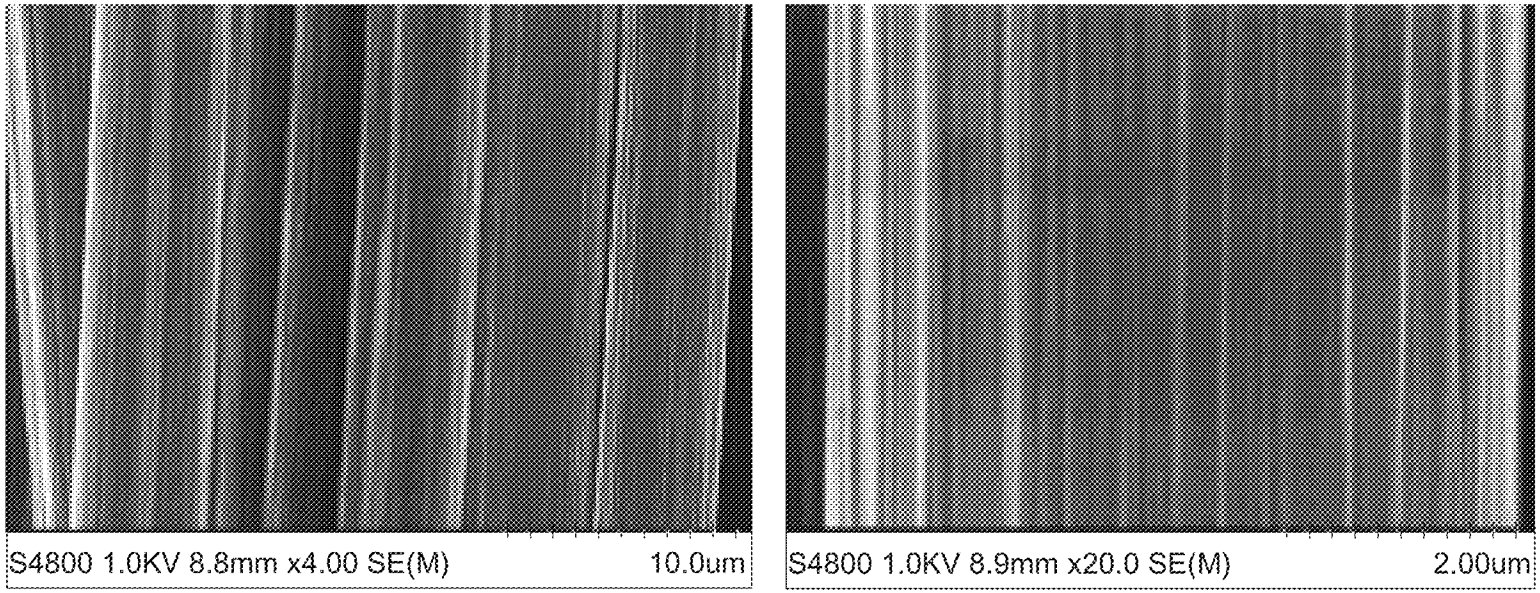
FIGS. 3A-B show a scanning electron microscopy (SEM) comparison between an embodiment of the disclosed sizing method and a conventional emulsification sizing method used for the application of epoxy sizing material onto carbon fiber.
Figure 3B:
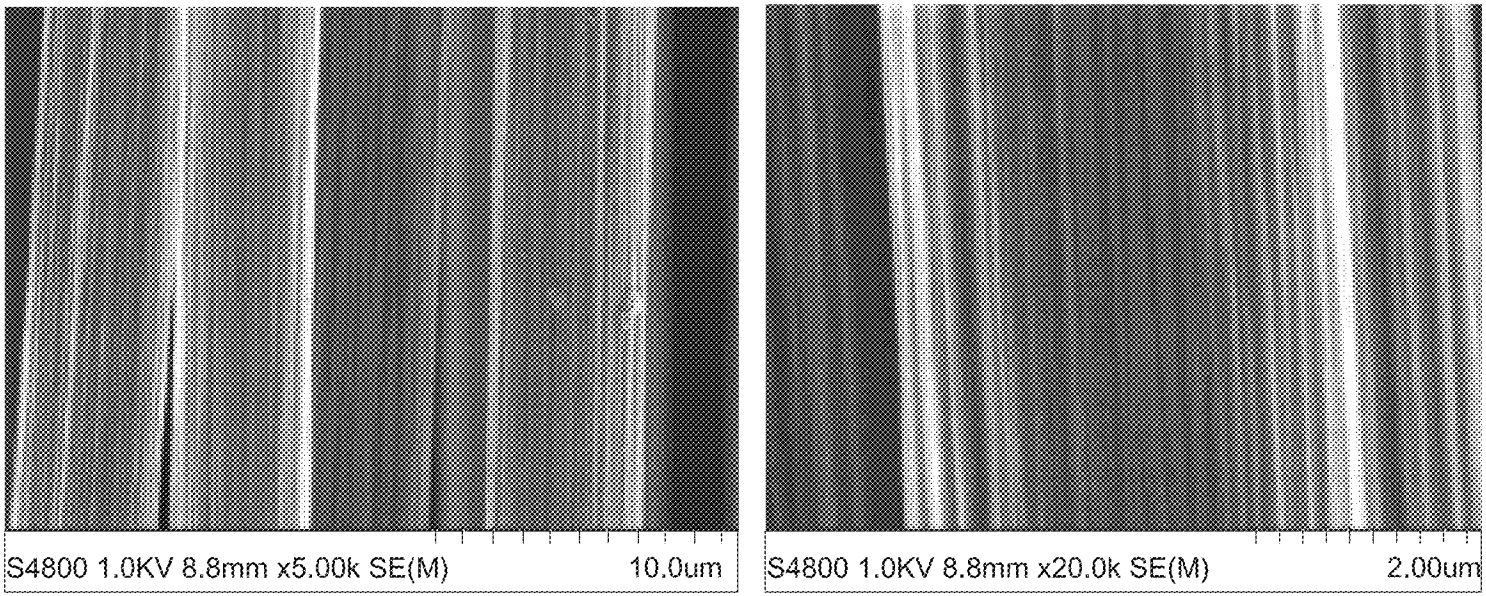
Figure 4A:
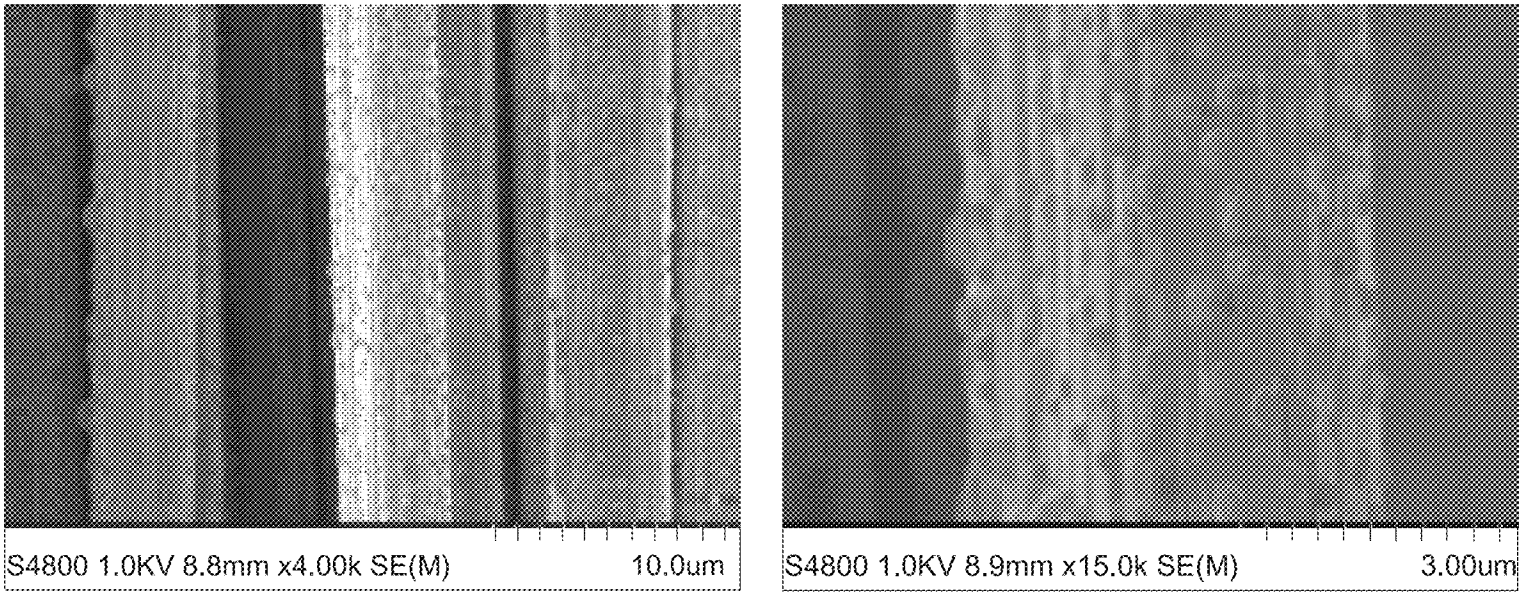
FIGS. 4A-B show an SEM comparison using a thermoplastic polyethersulfone sizing for dimethylsulfoxide (DMSO) and N-methylpyrrolidinone (NMP) solvents. As shown, use of different types of solvent can control the surface morphology of resulting sizing film on carbon fiber.
Figure 4B:
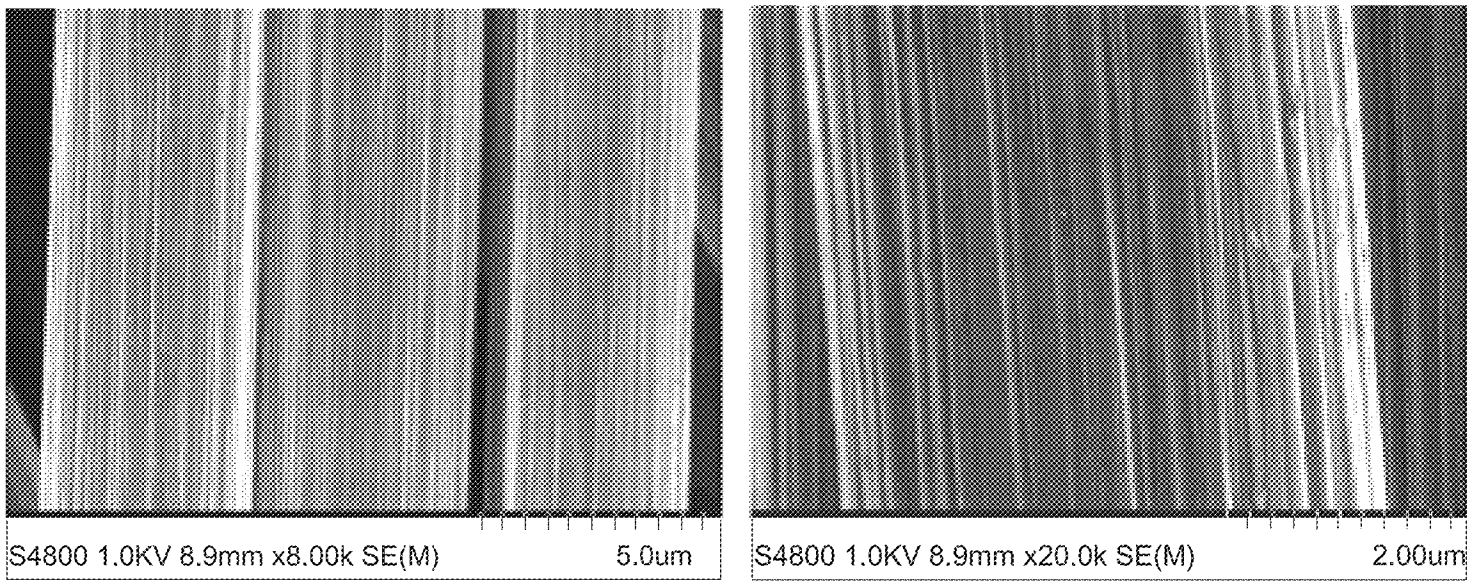

FIGS. 3A-B illustrate the surface of a carbon fiber coated by an embodiment of the above methods (FIG. 3A) with DER-337 epoxy sizing by the Dow Chemical Company as compared to a carbon fiber coated by an embodiment of an emulsion process of the prior art (FIG. 3B) using AP-200 sizing by Cytec Industries, which contains DER-337 as a base component. As shown by scanning electron microscope (SEM), carbon fibers coated in embodiments of the disclosed method have an almost identical surface appearance compared to a conventional emulsion process. Therefore, as shown in FIGS. 3A-B, the coagulation sizing process described herein can produce the same sort of generally uniform sizing coating as by a conventional emulsion sizing process. Accordingly, the coating method described herein can sufficiently cover a carbon fiber as well as or better than conventional methods, and does not have the same drawbacks. For example, unlike conventional emulsion processes, high MW polymeric sizing materials can be used, as described herein.

FIGS. 4-8 illustrate the surfaces of carbon fibers resulting from applying sizing using various fiber, sizing, and solvent compositions, as imaged by SEM. FIG. 4A illustrates a polyethersulfone sizing (KM-177 polyethersulfone by Cytec Industries) applied to carbon fiber using DMSO as a solvent. As shown, the sizing adheres to the carbon fibers in bead-like structures, which are uniformly distributed. FIG. 4B illustrates the same sizing material, but uses NMP as the solvent. As shown, there are little or no beads of polyethersulfone formed on the carbon fiber, but instead a generally uniform and smooth coating is formed. This may occur due to the different solvent powers of the DMSO and the NMP. Therefore, depending on the type of solvent, different surface configurations or morphologies can be created by the sizing on the carbon fibers, and different fiber-matrix interfacial properties can be formed. The type of configuration or morphology is not limited to beads or a smooth surface, and different types of surface configurations such as films, bumps, and whiskers can be created.

Figure 5:
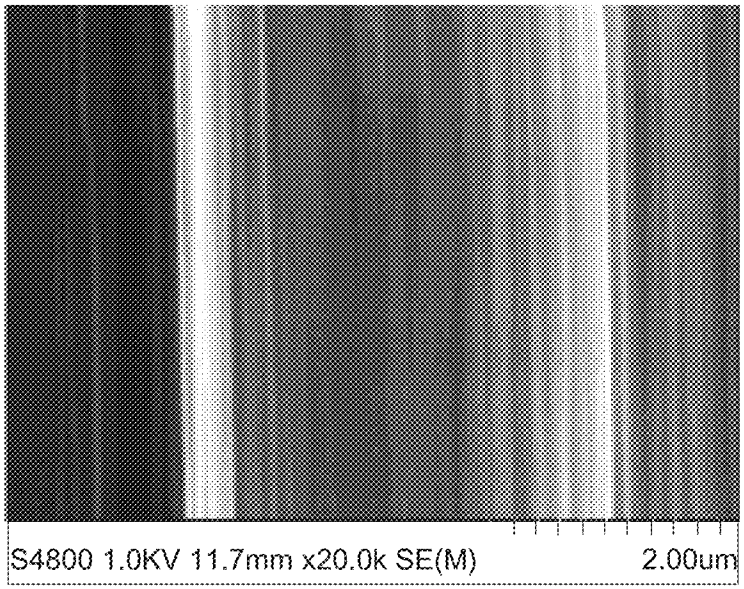
FIG. 5 shows SEM images of an epoxy/thermoplastic blend combination sizing material applied onto carbon fiber using DMSO solvent.
Figure 5:
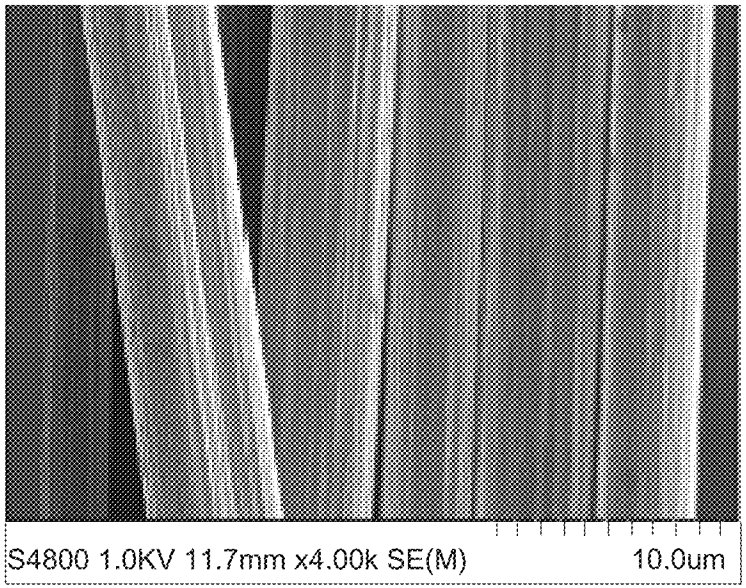

FIG. 5 illustrates a polyethersulfone/epoxy (about 50/50 by weight; KM-177 polyethersulfone by Cytec Industries and DER-337 epoxy by the Dow Chemical Company) composition as a sizing applied to carbon fiber using DMSO. Unlike the sizing of FIG. 4A, the sizing is applied in a generally smooth coating using the DMSO. Therefore, the surface configuration can be affected not only by the type of solvent, but also by the type of material mixed with it. In some embodiments, mixed or blended sizings can be used. In some embodiments, good film forming sizings, such as bis-A epoxy, can be used to facilitate the application of other sizing, such as anthracene epoxy.

Figure 6A:
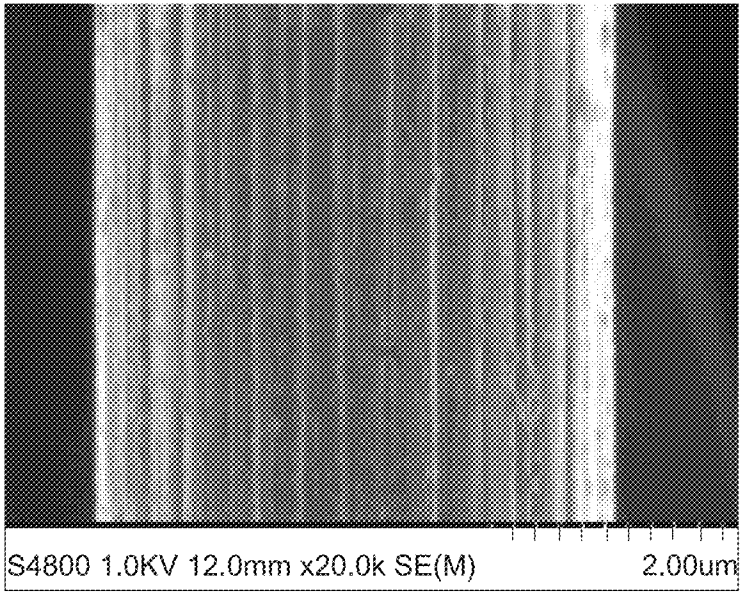
FIGS. 6A-B show an SEM comparison of polyimide sizing for DMSO and NMP solvents. As shown, using different types of solvent can control the surface morphology of resulting sizing film on carbon fiber.
Figure 6A:
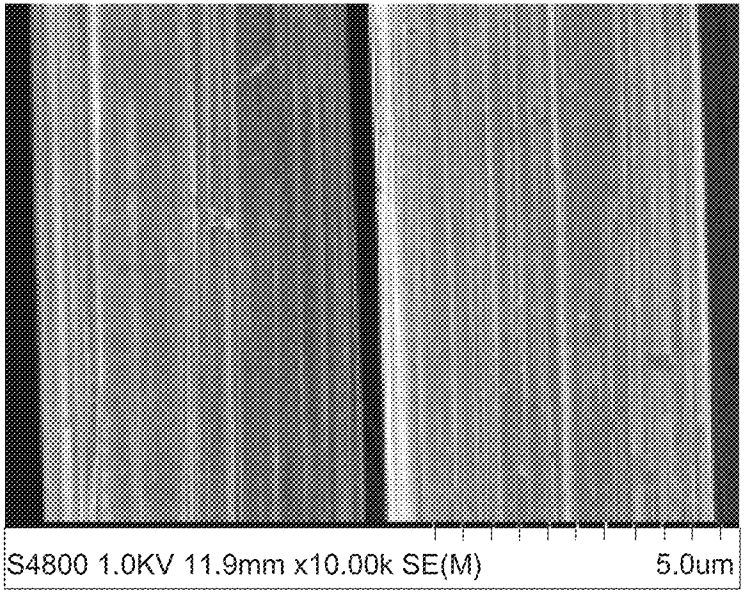
Figure 6B:
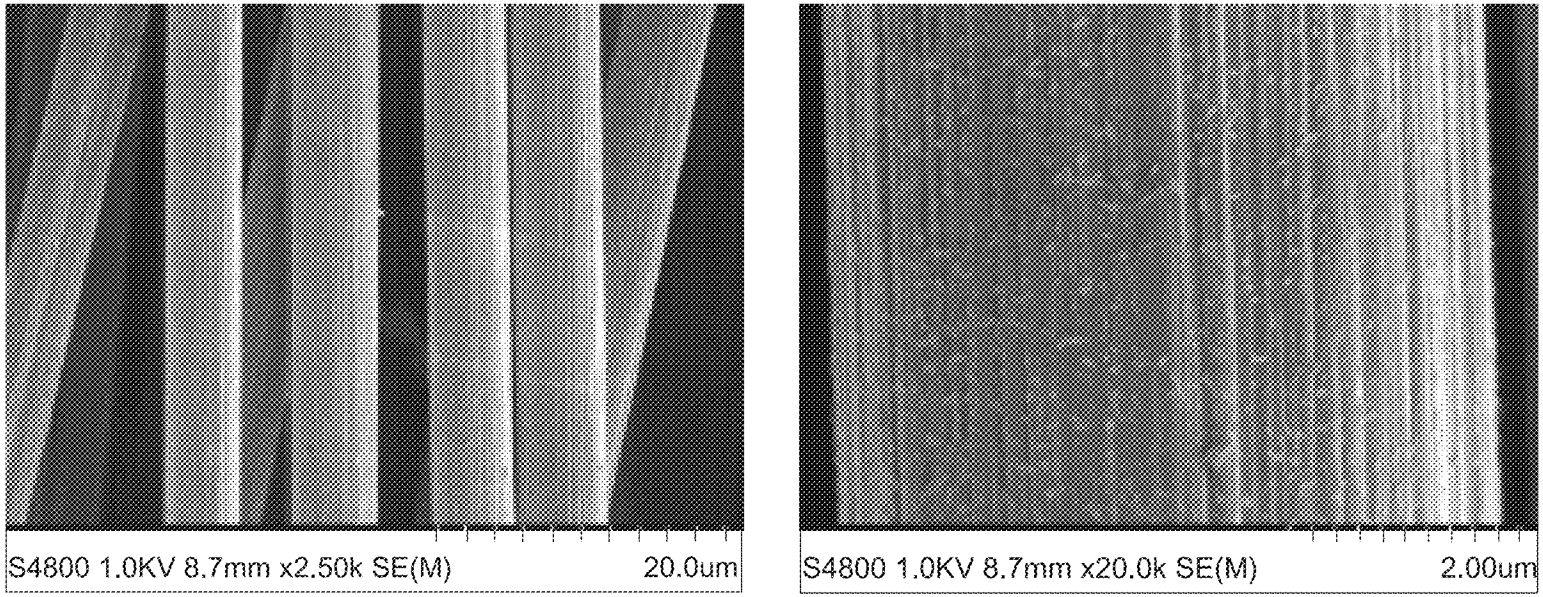
Figure 7:
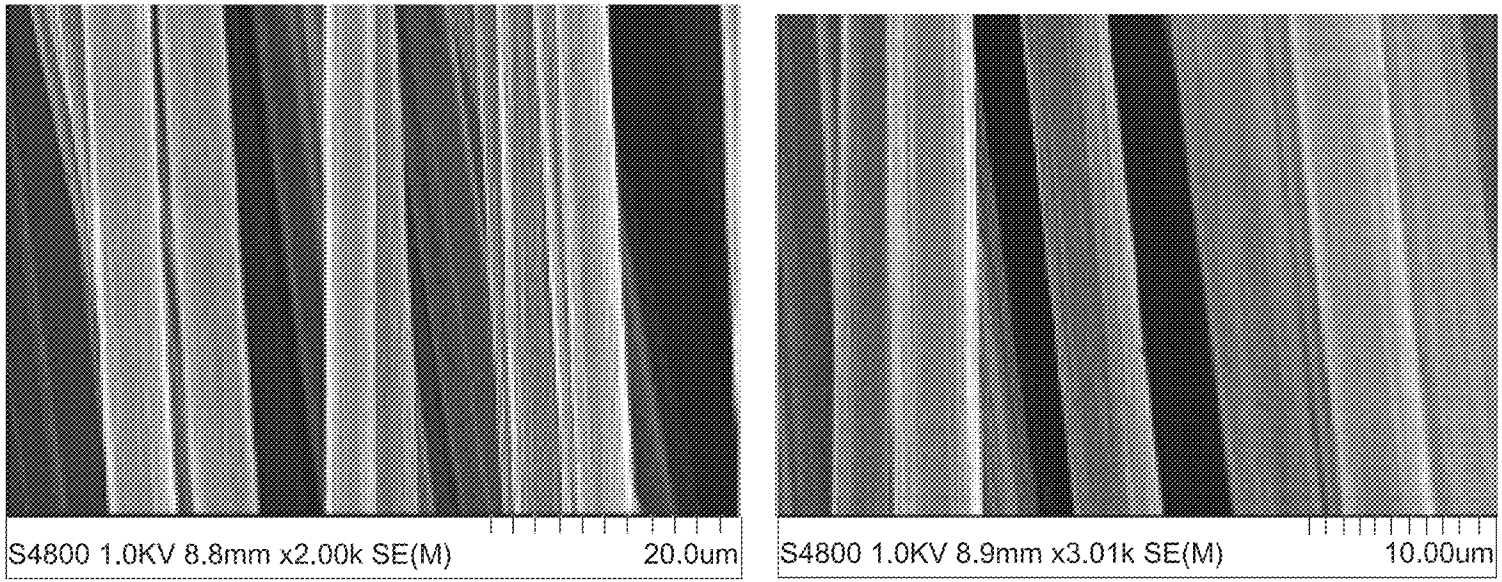
FIG. 7 shows SEM images of a core shell rubber sizing material applied onto carbon fiber using DMSO solvent.
Figure 8:
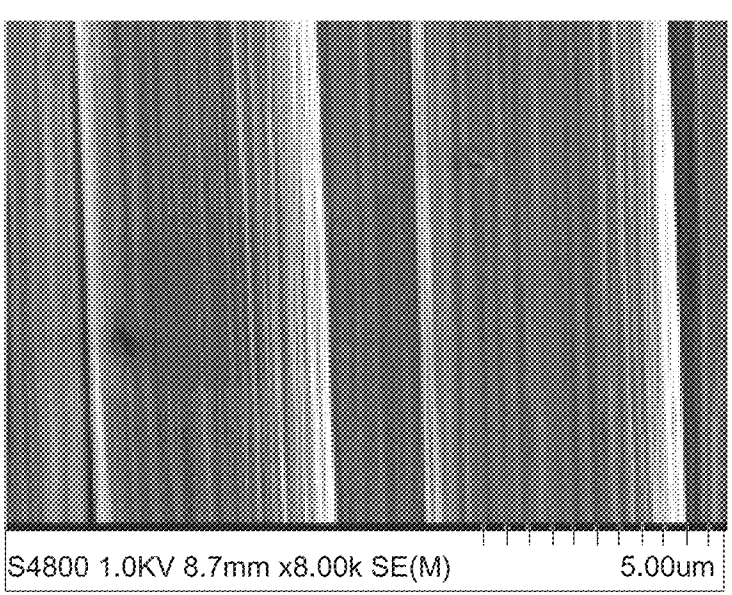
FIG. 8 shows SEM images of an epoxy resin/core shell rubber combination sizing material applied onto carbon fiber using DMSO solvent.
Figure 8:
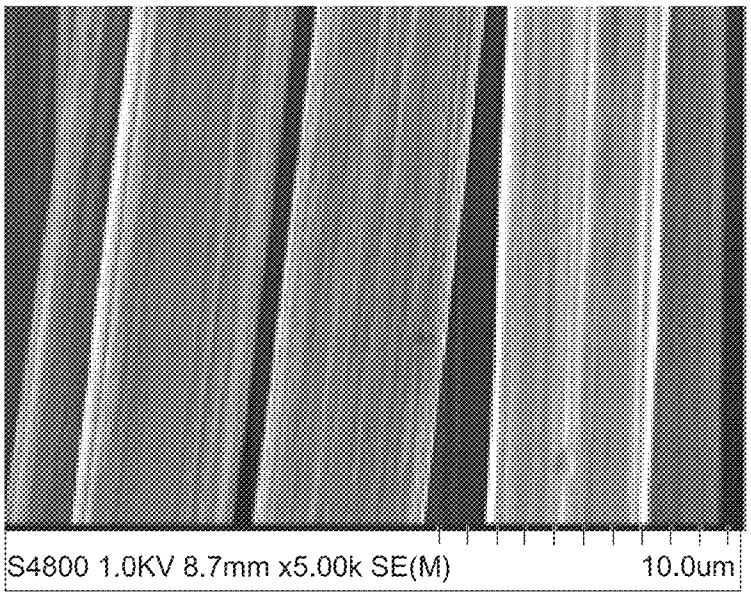

FIGS. 6A-B illustrate a polyimide thermoplastic sizing (P-84 polyimide by Evonik Industrial) applied to carbon fiber using DMSO and NMP, respectively. As shown in the figures, when DMSO was used, the sizing formed small bumps on the fiber surface. However, when NMP was used, whisker-like coatings were formed. FIG. 7 illustrates a rubber sizing (MX-181 core-shell rubber by Kaneka Corporation) applied to carbon fiber using DMSO, and FIG. 8 illustrates a 30:100 (wt. %/wt. %) rubber/epoxy sizing (MX-181 core-shell rubber by Kaneka Corporation and DER-337 Epoxy by the Dow Chemical Company) applied to carbon fiber using DMSO. As shown, the rubber can be used to modify the epoxy sizing, which may then produce a fiber capable of delivering improved impact performance in a composite.

Figure 9B:
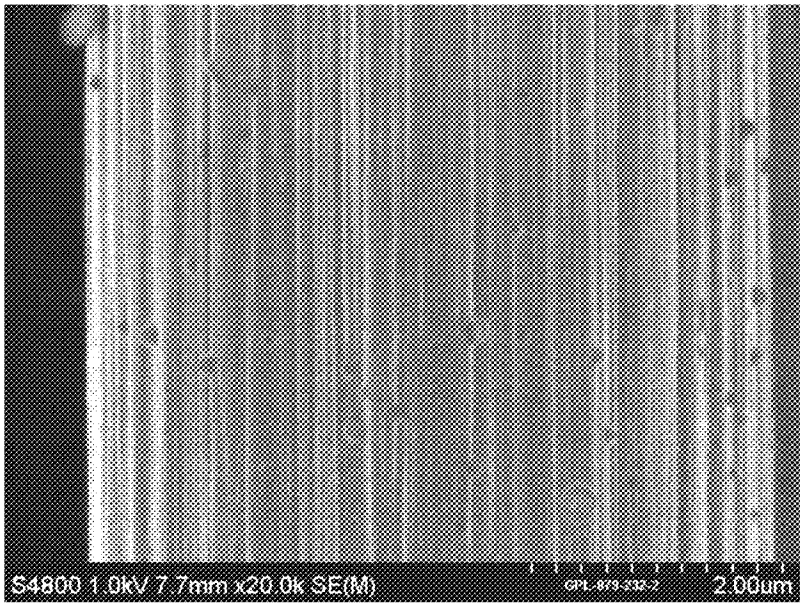
FIGS. 9A-B show SEM images of a polyether ether ketone (PEEK) sizing material applied onto a carbon fiber using sulfuric acid.
Figure 9A:
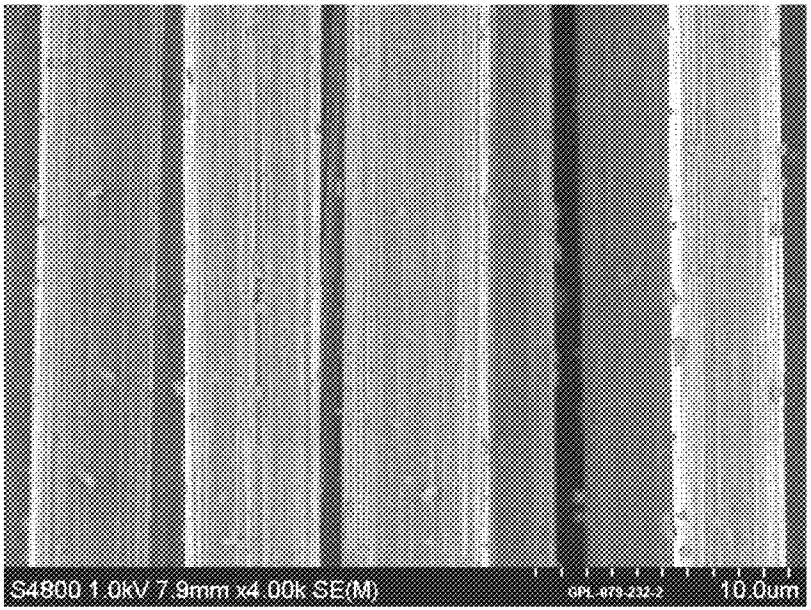

FIGS. 9A-B illustrate a polyether ether ketone thermoplastic sizing (APC2 PEEK by Cytec Industries) applied to carbon fiber using strong sulfuric acid (96%). As shown in the SEM photos, when the strongly acidic environment changes, the sizing can coagulate and/or adhere to the carbon fibers, for example, when the strength of the acid is reduced after the addition of water as described above. Accordingly, strong acids or strong bases can be used in the above described process.

In some embodiments, size pickup by the fibers can be higher for certain solvents than others. Different solvents, solvent types, solvent concentrations, fiber surfaces can also affect size pickup. Generally, a rougher surface of the fiber can lead to a higher pickup, whereas a smoother fiber surface can lead to a lower pickup.

As described above, embodiments of the above disclosure can produce a fiber coated with a sizing material by use of a solvent mixture. The disclosed method can substantially avoid formation of solvent vapor with use of at least one water bath, thereby increasing the safety of manufacturing the fibers as well as decreasing the potential negative environmental impact. The disclosed process can be operated in a manner that provides results comparable to, if not better than, conventional emulsification sizing methods currently in use. This is because the presence of the emulsifiers (e.g., surfactants) in the resulting composite can weaken the polymer matrix and interface between fibers and polymer matrix. Further, issues of emulsion stability could lead to non-uniform (e.g., blogs) sizings coated on the fiber surface.

Applications

Embodiments of the methods disclosed herein can be used to make fibers, or composite material having such fibers embedded in a thermoset or thermoplastic resin or polymer, wherein the size adheres to the surface of the fibers. The fibers made by embodiments of the disclosed method can then be used for a variety of purposes, all of which are non-limiting. For example, fibers manufactured by the above disclosed process can be used in baseball bats, electronic cases, and golf clubs. Further, fibers can be particularly advantageous in the aerospace and automotive fields due to the high strength-to-weight ratio and good rigidity. For example, the fibers can be used in airplanes such as commercial and military aircrafts, sporting goods, automotive, and general aerospace and industries. The carbon fibers described above can be used in primary structures, such as the wings, fuselage, and tail, as well as secondary structures, such as interiors.

Although the foregoing description has shown, described, and pointed out the fundamental novel features of the present teachings, it will be understood that various omissions, substitutions, and changes in the form of the detail of the apparatus as illustrated, as well as the uses thereof, may be made by those skilled in the art, without departing from the scope of the present teachings. Consequently, the scope of the present teachings should not be limited to the foregoing discussion, but should be defined by the appended claims.

What is claimed is:

1. A method of applying a sizing onto a carbon fiber, the method comprising the steps of:

providing a quantity of carbon fibers;

contacting the quantity of carbon fibers with a composition, wherein the composition comprises a non-water soluble polymer dissolved in a water-miscible solvent;

coagulating the non-water soluble polymer onto the quantity of carbon fibers, thereby forming a solvent/polymer coating on the quantity of carbon fibers;

removing the water-miscible solvent by washing the quantity of carbon fibers having the solvent/polymer coating with water; and at least partially drying the resultant quantity of polymer-coated carbon fibers to produce a quantity of sized carbon fibers.

2. The method of claim 1, wherein the water-miscible solvent is chosen from dimethyl sulfoxide (DMSO), N-methyl-2-pyrrolidone (NMP), dimethylformamide (DMF), hexamethylphosphoramide (HMPA), acetone, methylethyl ketone, butanone, methyl alcohol, ethyl alcohol, isopropyl alcohol, butyl alcohol, di-chloro methane, chloroform, sodium thiocyanate and zinc chloride.

3. The method of claim 1, wherein the water-miscible solvent has a pH of about 10 or greater, or about 3 or less.

4. The method of claim 1, wherein the water-miscible solvent is a strong base or a strong acid.

5. The method of claim 1, wherein the non-water soluble polymer is chosen from epoxies, thermoplastics, rubbers and combinations thereof.

6. The method of claim 5, wherein the non-water soluble polymer is chosen from polyether sulfone, polyether ketone, bis A epoxy, bis F epoxy, phenoxy, phenolic, vinyl ester, bismaleimide (BMI), polyimide, polyamide imide, diglycidyl ether of bis-phenol A epoxy, core-shell rubber, anthracene epoxy, naphthalene epoxy, novalac epoxy, tri-functional epoxy, tetra-functional epoxy and combinations thereof.

7. The method of claim 1, wherein the non-water soluble polymer is modified by a modifier chosen from rubber particles, inorganic particles, organic particles, additives and combinations thereof.

8. The method of claim 7, wherein the modifier is chosen from graphene sheets, carbon microbeads, silica nanotubes, silica carbide nanotubes, nanoclays, and combinations thereof.

9. The method of claim 1, wherein the non-water soluble polymer has an epoxy equivalent weight of about 300 or greater.

10. The method of claim 9, wherein the non-water soluble polymer has an epoxy equivalent weight of about 500 or less.

11. The method of claim 1, wherein the non-water soluble polymer is a combination of different non-water soluble polymers.

12. The method of claim 1, wherein substantially no solvent vapor is produced during the at least partially drying step.

13. The method of claim 1, wherein a surfactant is not used.

14. The method of claim 1, wherein water is substantially removed from the quantity of fibers during the at least partially drying step.

15. The method of claim 1, wherein a post-bath composition comprising water, water-miscible solvent and non-water soluble polymer is formed during the washing.

16. The method of claim 15, further comprising recycling one or more components of the post-bath composition.

17. A method for applying sizing onto a carbon fiber and minimizing solvent vapor formation, the method comprising the steps of:

combining a non-water soluble polymer with a water-miscible solvent to form a sizing composition, wherein the non-water soluble polymer is dissolved in the sizing composition;

applying the sizing composition to at least one carbon fiber;

coagulating the polymer onto the at least one carbon fiber, thereby at least partially coating the at least one carbon fiber with the non-water soluble polymer in the sizing composition;

removing the water-miscible solvent from the at least one carbon fiber; and at least partially drying the at least one carbon fiber after the water-miscible solvent has been removed;

wherein substantially no solvent vapor is created during the at least partially drying step.

18. The method of claim 17, wherein coagulating the non-water soluble polymer and removing the water-miscible solvent further comprises applying water to the at least one carbon fiber.

* * * * *